US006199617B1

(12) United States Patent
Schweiss

(10) Patent No.: US 6,199,617 B1
(45) Date of Patent: Mar. 13, 2001

(54) BI-FOLD DOOR LIFT APPARATUS

(75) Inventor: Michael L. Schweiss, Fairfax, MN (US)

(73) Assignee: Schweiss Distributing, Inc., Fairfax, MN (US)

( * ) Notice: Subject to any disclaimer, the term of this patent is extended or adjusted under 35 U.S.C. 154(b) by 0 days.

(21) Appl. No.: 09/314,529

(22) Filed: May 19, 1999

(51) Int. Cl.[7] ..... E05F 15/10

(52) U.S. Cl. ..... 160/193; 160/188; 160/207; 242/587.1; 242/584.1

(58) Field of Search ..... 160/188, 207, 160/193, 218, 190, 191, 192; 242/584.1, 587.1, 598.6; 254/294

(56) References Cited

U.S. PATENT DOCUMENTS

| | | | | |
|---|---|---|---|---|
| 325,986 | * | 9/1885 | Spangle | 242/584.1 |
| 1,962,839 | | 6/1934 | Repetto et al. . | |
| 1,994,785 | * | 3/1935 | Premo | 160/207 |
| 2,152,000 | | 3/1939 | Stone . | |
| 2,274,216 | * | 2/1942 | Sanders | 160/207 |
| 3,155,147 | * | 11/1964 | Smith | 160/207 |
| 4,008,863 | * | 2/1977 | Fohl | 242/587.1 |
| 4,088,172 | * | 5/1978 | Pollock | 160/207 |
| 4,545,418 | * | 10/1985 | List et al. | 160/207 |
| 4,609,027 | * | 9/1986 | Keller | 160/207 |
| 4,949,772 | * | 8/1990 | Ballyns et al. | 160/201 |
| 5,052,459 | | 10/1991 | Grossenbacher . | |
| 5,149,057 | * | 9/1992 | Meurer | 254/294 |
| 5,168,914 | * | 12/1992 | Keller | 160/207 |
| 5,343,923 | * | 9/1994 | Keller | 160/207 |
| 5,476,130 | | 12/1995 | Cheng . | |
| 5,601,131 | * | 2/1997 | Morris | 160/207 |

* cited by examiner

*Primary Examiner*—Blair M. Johnson

(57) ABSTRACT

A bi-fold door is equipped with door lifting devices operated with an electric motor drive to selectively open and close the door. The door lifting devices have winches operable to wind and unwind elongated webs connected at one end to rotatable members of the winches and anchored at the opposite end to the door. Anchors mounted on the door have adjustable sleeves operable to adjust the working lengths of the webs.

40 Claims, 9 Drawing Sheets

BI-FOLD DOOR LIFT APPARATUS

FIELD OF THE INVENTION

The invention is in the art of power lifts for doors. The power lift opens and closes a bi-fold door with reversible motor driven winches having webs anchored to the door.

BACKGROUND OF THE INVENTION

Agricultural, aviation, and commercial buildings have large side and end walls with openings to accommodate vehicles, equipment, aircraft and large machinery. Bi-fold doors hinged to side and end wall frames of the building are used to selectively open and close the openings. Bi-fold doors have upper and lower door panels hinged along adjacent sections with the upper panel hinged to the headers located above the openings. Manually operated winches have been used to open and close bi-fold doors. Winches driven with electric motors are also used to open and close bi-fold doors. The winches have cables, such as aircraft cable, and cylindrical drums which rotate to wind and unwind cables on and from the drums. The cables wind along the length of the drums which have longitudinal lengths to accommodate the cable turns. The upper ends of the cables are secured to the top of the upper door panel. The electric motors rotate the drums to wind the cables on the drums to open the bi-fold doors. When the drive of the electric motors is reversed, the cables are unwound from the drums to allow the bi-fold doors to move from the open positions to the closed positions. The bi-fold door opening and closing episodes occur at a constant speed determined by the speed of rotation of the winch drums. The cables require periodic adjustments and maintenance and are subject to wear which reduces their working life.

SUMMARY OF THE INVENTION

The invention is an apparatus for opening and closing a bi-fold door in a minimum of time without loss of headroom in the structure having side and end walls with an opening closed with a bi-fold door. The bi-fold door has upper and lower panels pivotally connected with hinges that allow the panels to be moved from a planar aligned closed position to a side-by-side open position. The upper-panel is hinged to a header extended over the doorway. A plurality of door lift devices mounted on one panel are used to selectively open and close the bi-fold door. A power unit having a reversible drive motor operably connected to the door lift devices functions to operate the power lift devices. The power lift devices have elongated flexible webs having first and second ends. The first end of the web is connected to a shaft having a member for accommodating overlapping web windings. The shaft connected to the power unit rotates in one direction to wind the web around the member to articulate the bi-fold door from the closed position to the open folded position. The speed of the opening episode of the bi-fold door increases as the door elevates to the open folded position due to the increase in diameter of the overlapped web on the member. When the shaft is rotated in the direction opposite the one direction, the web unwinds from the member to allow the door to articulate back to its closed position. The speed of the closing episode of the bi-fold door decreases as the door moves to the closed position. The second end of the web is attached to an anchor mounted on the other panel of the bi-fold door. The anchor is provided with an appliance for adjusting the working length of the web so that the bi-fold door articulates to the full open and closed positions.

The preferred embodiment of the apparatus for opening and closing a bi-fold door has a plurality of door lift devices that operate to move the door from a generally vertical closed position to a generally horizontal open position. The bi-fold door has upper and lower panels having top and bottom horizontal frame members and sheathing attached to the frame members. Hinges attached to adjacent top and bottom frame members of the upper and lower panels allow the panels to pivot to locate the panels in side-by-side relationship when the door is in the open position. The top frame of the upper panel is pivotally connected to a header extended across the top of the doorway or opening in a wall of the structure, such as a building. A plurality of door lift devices mounted on the bottom frame member of the lower panel are laterally spaced along the length of the bottom frame member. A main drive shaft connected to the door lift devices concurrently transmits torque from a power unit to the door lift devices whereby the door lift devices act together to articulate the panels from their closed positions to the folded open position. The power unit is mounted on the lower panel. The power unit includes a reversible motor and a gear box coupling the motor to the shaft. Each of the door lift devices has a winch mounted on the bottom frame member of the lower panel. The winch has a shaft connected to the main drive shaft whereby the power unit operates the winch. A cylindrical member secured to the drive shaft is connected to an elongated linear, flat and flexible web, such as a nylon or polyester web having a width of 2 or 3 inches. The web has a first end loop connected to the shaft with web guide plates attached to the shaft adjacent opposite ends of the cylindrical member and a rigid member extended through the first end loop and secured to the guide plates. A cylindrical shield surrounds the guide plates and first end loop. The shield has a slot accommodating the web which extends upwardly to a roller unit secured to the top frame member of the upper panel. The web extends over a roller rotatably mounted on the roller unit and downwardly to an anchor mounted on a frame member of the upper panel. The anchor has a sleeve attached to the second end of the web. The sleeve is rotated to wind a portion of the web on the sleeve to adjust the working length of the web. In order to maintain tension on the web, a locking nut and thread member attached to the sleeve is used to hold the sleeve and second end of the web wound on the sleeve in an adjusted position. The working lengths and tension of all of the webs of the door lift devices are adjusted so that they act together to move the bi-fold door between its open and closed positions. The drive shaft is rotated in one direction by the drive unit to wind the web in overlapping relation on the cylindrical member to articulate the bi-fold door to the open position, During the door opening episode the opening speed of the door increases as a function of the increase in the diameter of the web wound on the cylindrical member. The closing speed of the door decreases as the web is unwound from the cylindrical member.

The door lifting devices with the webs are efficient, quiet, and relatively simple structures that have heavy duty and durable characteristics. There are less maintenance and adjustments of the door lifting devices as compared to prior manual and electric door opening systems. The webs are attractive in appearance and can be replaced with a minimum of time and labor.

DESCRIPTION OF THE INVENTION

Figure 2:
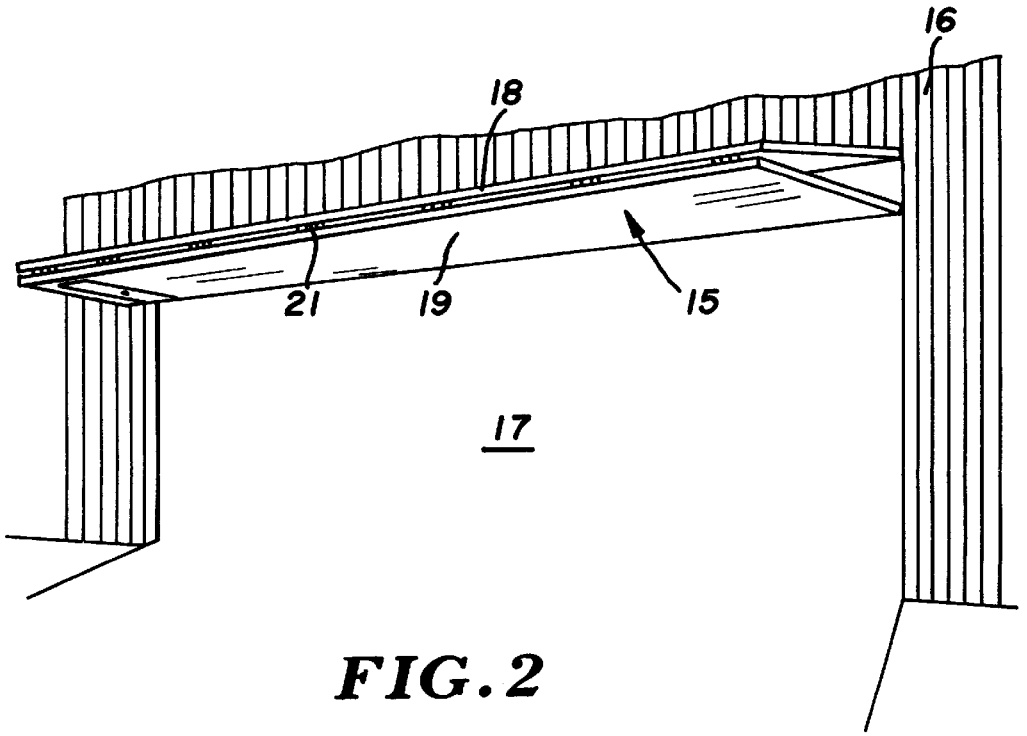
FIG. 2 is a perspective view of the bi-fold door of FIG. 1 in the open position.
Figure 3:
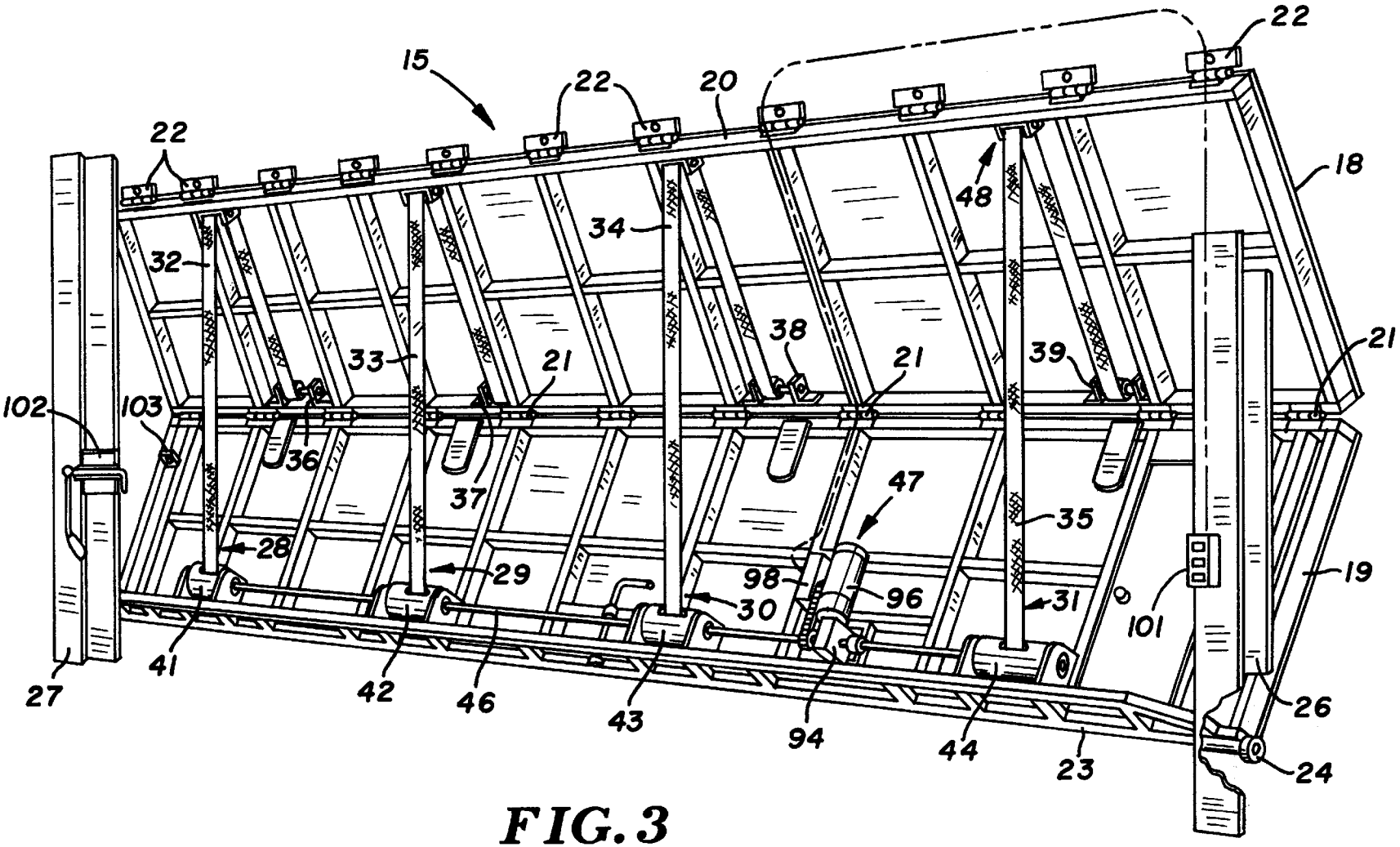
FIG. 3 is a perspective view of the inside of the bi-fold door of FIG. 1 in a partly open position.

Bi-fold doors are used in large and small buildings to conserve headroom and close relatively wide and high door openings. A bi-fold door 15 shown in FIG. 1 has an upper panel 18 and a lower panel 19 located in vertical orientation closing door opening or passageway 17 in an exterior wall 16 of a building. Panels 18 and 19 are rectangular framed structures having exterior sheeting, such as wood, plastic or metal. As shown in FIG. 3, a plurality of hinges 21 pivotally connect adjacent horizontal frame members of panels 18 and 19 to allow panels 18 and 19 to fold upwardly to an open side-by-side position as shown in FIG. 2. The top frame member 20 of upper panel 18 is connected to the header of wall 16 with a plurality of hinges 22. The outer ends of the lower frame member 23 of panel 19 supports rollers 24 which ride on upright tracks 26 and 27 located adjacent opposite ends of door 15.

Bi-fold door 15 is selectively moved to its open and closed positions with door lift devices indicated generally at 28, 29, 30, and 31 spaced along the length of the door. Door lift devices 28–31 have elongated flexible webs 32, 33, 34 and 35 attached to anchors 36, 37, 38 and 39 on bottom frame 53 of panel 18 and winches 41, 42, 43 and 44. The webs 32–35 are elongated flexible, flat and non-elastic members of plastic and fiber materials, such as Nylon and polyester webs. The width of each web is 2 to 6 inches. The size and width of the web can vary to accommodate the load of bi-fold door. Other types of materials can be used to make the webs. The number of door lift devices is selected according to the length, height, and weight of the bi-fold door. Large bi-fold doors can have more than four door lift devices. Small bi-fold doors can be opened and closed with two door lift devices. A drive shaft 46 coupled to each winch 41–44 is rotated with a power unit 47 to concurrently operate winches 41–44 to wind the webs 32–35 on generally cylindrical members to open door 15 and allow the webs 32–35 to unwind from the cylindrical members to close door 15. Several power units can be used to operate winches 41–44 and additional winches driveably connected to shaft 46.

The door lift devices 28–31 are identical in structure and function. The details of lift device 31 shown in FIGS. 4 to 11 are included in lift devices 28, 30, the following description is directed to lift device 31.

Figure 4:
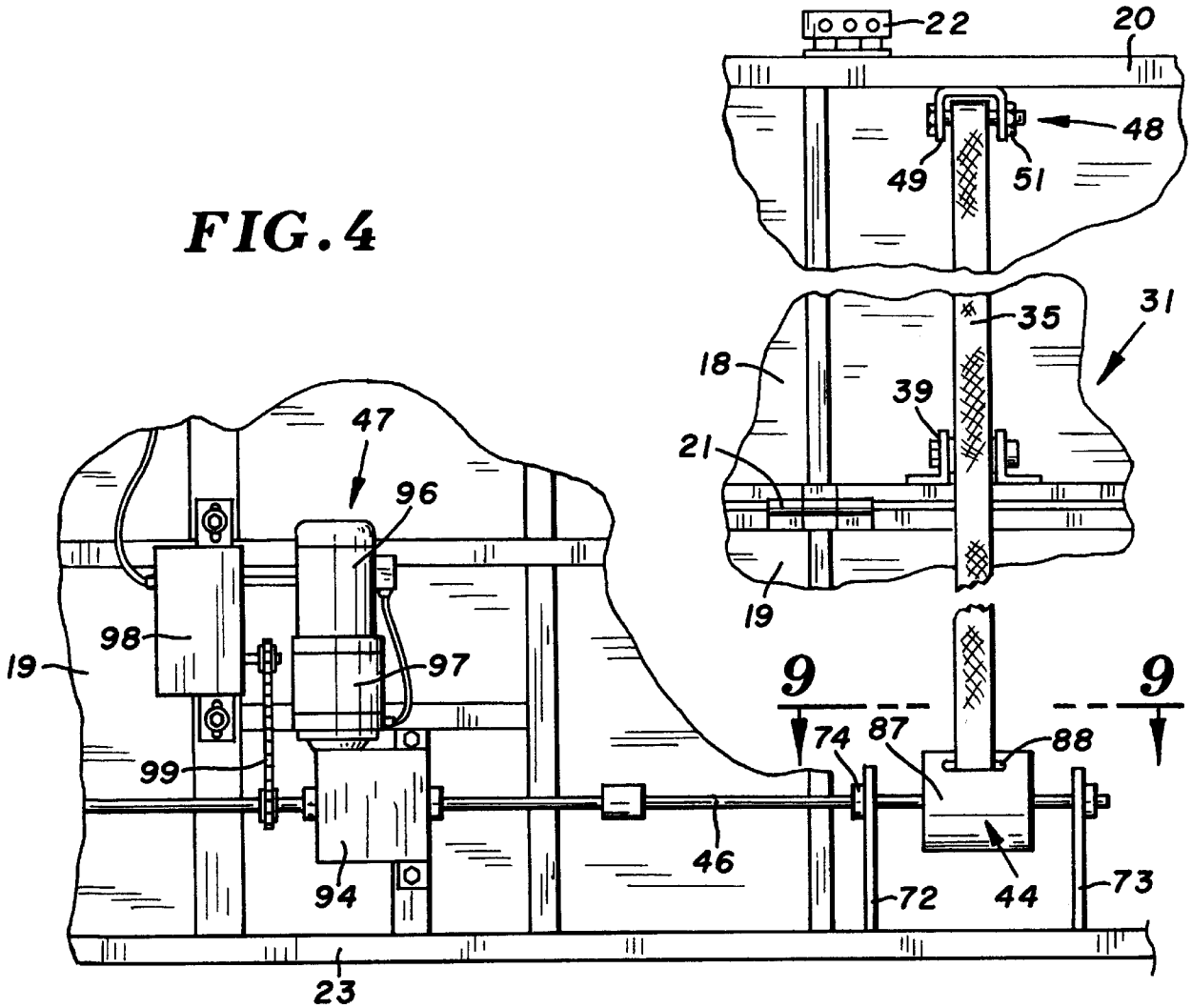
FIG. 4 is an enlarged foreshortened elevational view of the bi-fold door opening and closing apparatus of the invention.
Figure 5:
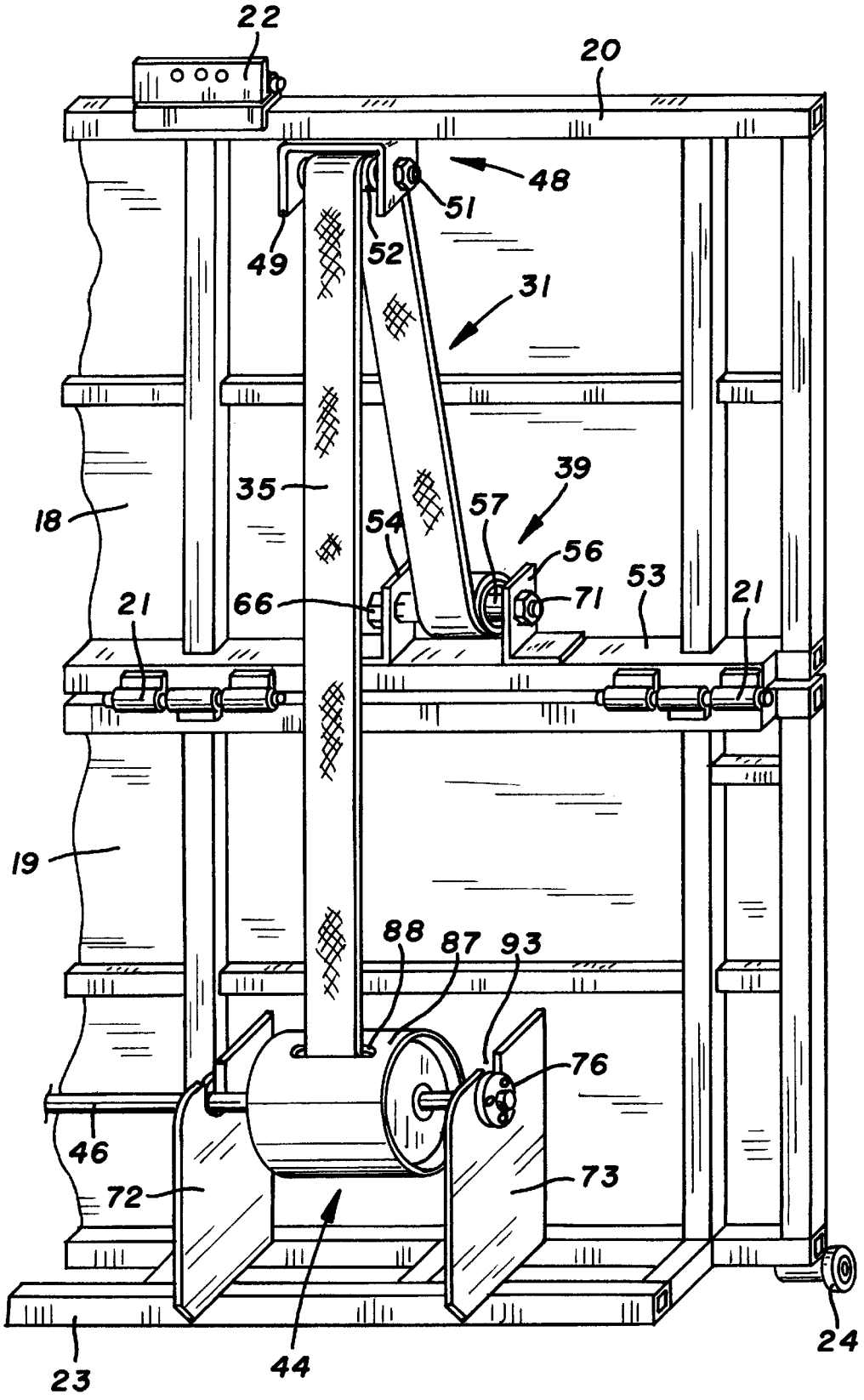
FIG. 5 is a perspective view of a door lift device of the bi-fold door opening and closing apparatus.
Figure 6:
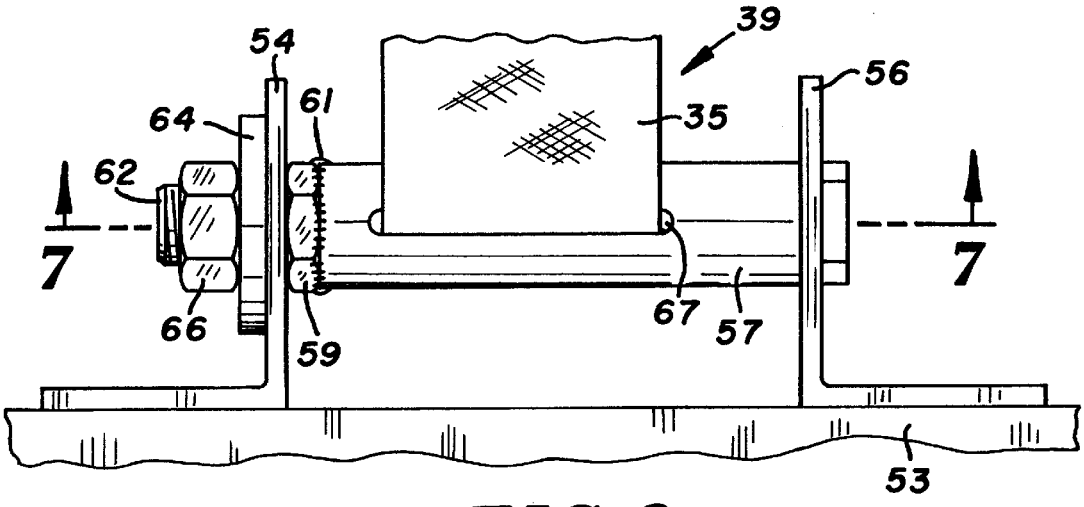
FIG. 6 is an enlarged elevational view of the anchor for the web of the bi-fold door lift device.
Figure 7:
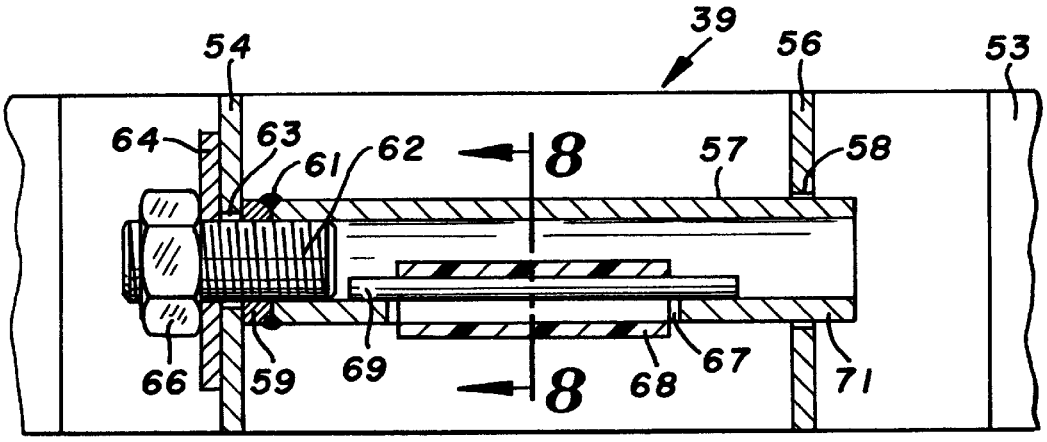
FIG. 7 is a sectional view taken along line 7—7 of FIG. 6.
Figure 8:
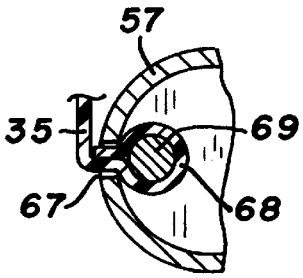
FIG. 8 is an enlarged sectional view taken along line 8—8 of FIG. 7.

As shown in FIGS. 4 and 5, an upper portion of web 35 extends through a roller assembly 48 mounted on top frame 20 of panel 18. Roller assembly 48 comprises an inverted U-shaped bracket 49 secured with welds or bolts to frame 20. A bolt 51 mounted on bracket 49 supports a roller or sleeve 52 within U-shaped bracket 49. Web 35 trained over roller 52 extends downwardly to anchor 39 mounted on bottom frame 53 of panel 18. The free end of web 35 is attached to anchor 39 as shown in FIGS. 7 and 8. Anchor 39 has angle supports 54 and 56 secured to frame 53 of panel 18. A tubular sleeve 57 located between supports 54 and 56 has an end 71 extended through hole 58 in support 56. The opposite end of sleeve 57 is connected to a nut 59 with a weld 61. A threaded member 62 accommodates nut 59 and extends through a hole 63 in support 54. A washer 64 surrounding member 62 engages the outside of support 56 and a nut 66 threaded on member 62. When nut 66 is turned in one direction washer 64 is clamped tight against support 54 to hold sleeve 57 in a fixed position. When nut 66 is turned in the opposite direction the clamp pressure of washer 64 on support 54 is released allowing sleeve 57 to rotate on supports 54 and 56. A middle section of sleeve 57 has a longitudinal slot 67 having a length to accommodate web 35. As shown in FIGS. 7 and 8, web 35 has an end loop 68 extended through slot 67. A rod 67 within sleeve 57 extends through loop 68 to anchor web 35 on sleeve 57. The end 71 of sleeve 57 is turned to wind web 35 on sleeve 57 to adjust the working length of web 35. Nut 66 is turned down to fix the adjusted position of sleeve 57. Sleeve 57, member 62 and nut 66 cooperating with support 56 is an appliance used to adjust the working length of web 35. All of the anchors 36–39 are adjusted to take up the slack of webs 32–35 and equalize the operating or working lengths of webs 32–35.

Figure 9:
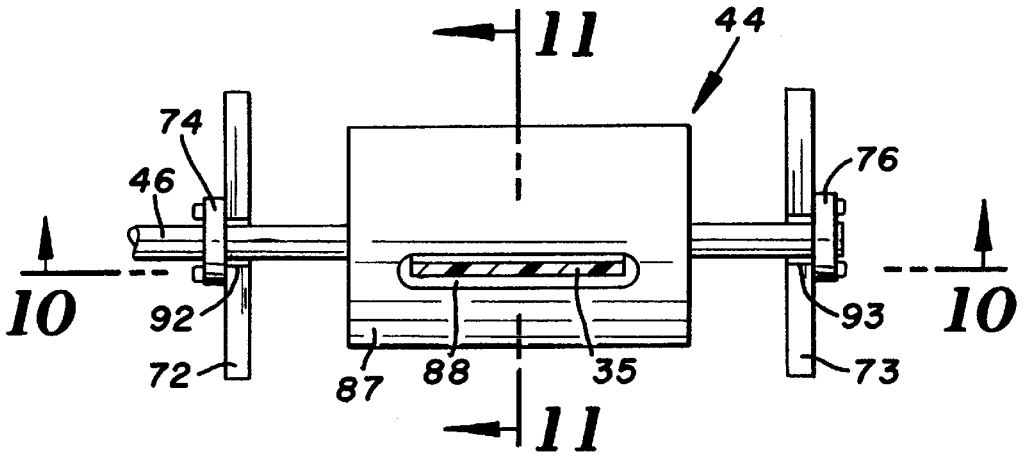
FIG. 9 is an enlarged sectional view taken along line 9—9 of FIG. 4.
Figure 10:
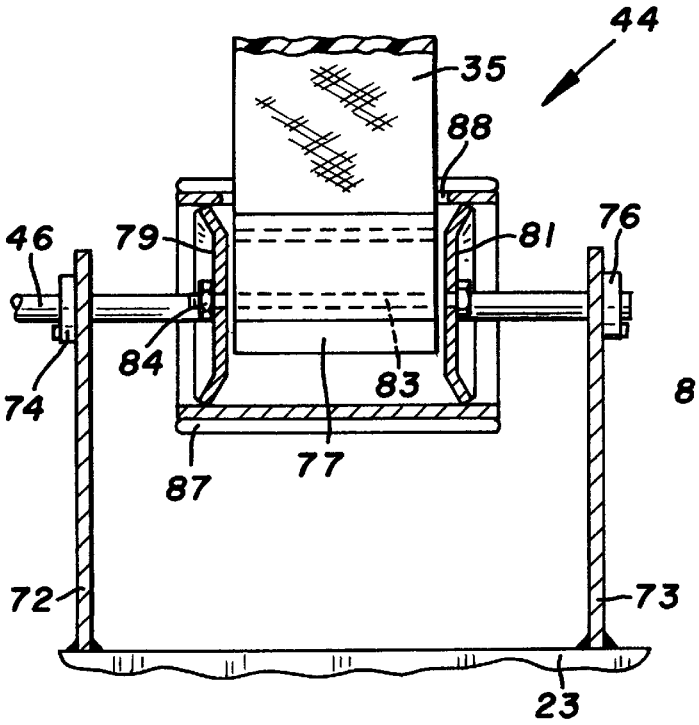
FIG. 10 is a sectional view taken along line 10—10 of FIG. 9.
Figure 11:
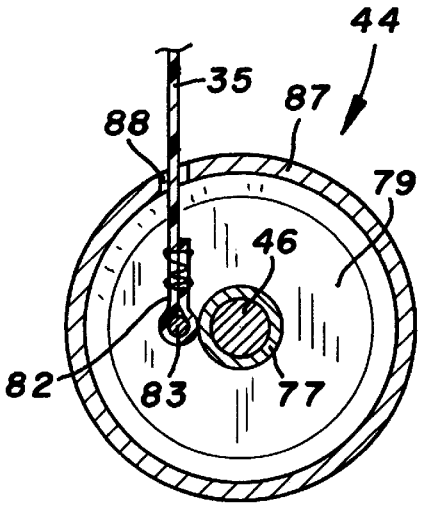
FIG. 11 is an enlarged sectional view taken along line 11—11 of FIG. 9.

As shown in FIGS. 5, 9 and 10, winch 44 is mounted on bottom frame 23 with a pair of upright support plates 72 and 73. The lower portions of plates 72 and 73 are secured to frame 23 with welds. Fasteners, such as bolts, can be used to secure plates 72 and 73 to frame 23. Plates 72 and 73 are parallel and laterally spaced from each other. Bearings 74 and 76 accommodating drive shaft 46 are mounted on plates 72 and 73. As shown in FIGS. 10 and 11, a bushing or generally cylindrical member 77 surrounds and is secured to the center section of shaft 46 between plates 72 and 73. Member 77 has a generally cylindrical outer surface 78 providing a drum surface for web 35. A pair of web guide plates 79 and 81 are secured to shaft 46 adjacent opposite ends of member 77. Web 35 has a looped end 82 located between guide plates 79 and 81. A rigid rod or bolt 83 extends through looped end 82 attaches web 35 to plates 79 and 81. A nut 84 retains bolt 83 on plates 79 and 81. As seen in FIG. 11, member 77 has a notch 86 accommodating a portion of looped end 82 and bolt 83 to reduce shear forces on bolt 83 and provide smooth spiral winding of web 35 around member 77.

An arcuate shield 87 extended between support plates 72 and 73 encloses guide plates 79 and 81, member 77 and looped end of web 35. Shield 87 is a split cylindrical member that rides on the outer circular edges of plates 79 and 81. A central section of shield 87 has a longitudinal slot 88 for web 35 which extends upwardly to roller assembly 48 and downwardly from roller assembly 48 to anchor 39. Web 35 retains shield 87 aligned with plates 79 and 81 and limits rotation of shield 89.

As shown in FIGS. 5 and 9, the upper portions of support plates 72 and 73 have recesses or cut outs 92 and 93 accommodating shaft 46. Winch 44 and shaft 46 are mounted as a unit on support plates 72 and 73 by locating winch 44 between plates 72 and 73. Bearings 74 and 76 accommodating shaft 46 are secured to support plates 72 and 73 to retain winch 44 and shaft 46 on plates 72 and 73.

Winches 41–44 can be mounted on frame 20 of upper panel 18. The webs 32–35 can extend downwardly from the winches around roller units attached to frame 23 to anchors mounted on lower panel 19. A power unit 47 having a reversible electric motor 96 mounted on panel 18 turns a drive shaft 46 connected to the winches to concurrently operate the winches to open and close the bi-fold door 15.

Returning to FIG. 4, power unit 47 includes a gear box 94 driven with a reversible electric motor 96. An electric brake unit 97 connects motor 96 to gear box 94. Brake unit 97 locks gear box when the electric power to motor 96 is shut off which prevents movement of bi-fold door 15. Gear box 94 is driveably connected to shaft 46 to selectively rotate shaft 46 in opposite directions thereby concurrently operating winches 41–44 to open and close bi-fold door 15. A jack shaft chain and sprocket drive can be used to operatively connect gear box 94 with shaft 46. A limit switch unit 98 mounted on the frame of panel 19 adjacent motor 96 controls the electric power to motor 96 responsive to the open and closed positions of bi-fold door 15. A chain and sprocket drive 99 driveably connects limit switch 98 to shaft 46 to index limit switch 98 with the open and closed positions of bi-fold door 15. A manually operated switch 101, shown in FIG. 3, wired to limit switch 98 is used by a person to control the electric power supplied to motor 96. Switch 101 has UP, DOWN and STOP buttons used by the person to control the opening and closing of bi-fold door 15. Other types of switches can be used to control the operation of motor 96.

As shown in FIG. 3, a latch 102 attached to track 27 or a side column of structure 16 engages a catch 103 or U-hook secured to the frame of panel 19 of door 15 to maintain bi-fold door 15 in the closed position. A second latch (not shown) mounted on track 26 cooperates with a catch on panel 19 to assist latch 102 to maintain bi-fold door 15 in the closed position. Both latches must be released before power unit 47 is actuated to open bi-fold door 15.

Figure 1:
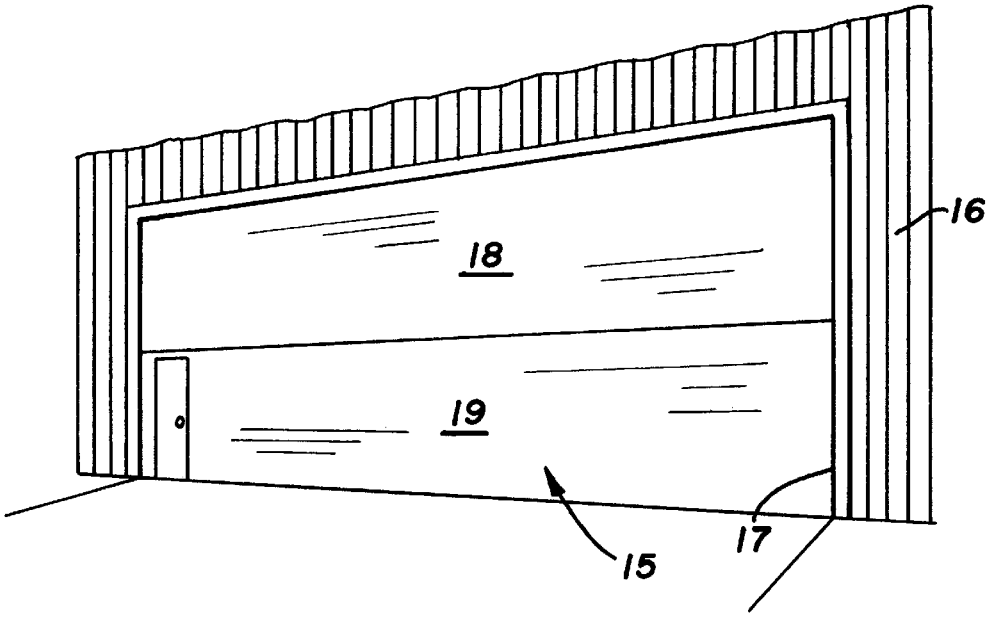
FIG. 1 is a perspective view of a bi-fold door closing a doorway of a building equipped with the door opening and closing apparatus of the invention.

In use when bi-fold door 15 is in the closed position, as shown in FIGS. 1, 4, and 5, panels 18 and 19 located in a common vertical plane close the doorway or opening 17 in structure 16. The latches 102 cooperate with catches 103 on opposite ends of panel 19 to hold bi-fold door 15 closed. Latches 102 must be released before door 15 can be moved to the open position. The door operator uses the push button door control switch 101 mounted on track 26 or the door frame to connect electric motor 96 to electric power whereby motor 96 drives gear box 94 which turns drive shaft 46. As shown in FIGS. 10 and 11 web end 82 is attached to shaft 46 adjacent cylindrical member 77 so that the web winds up on its self around member 77. The windings of the web 35 around member 77 overlap each other. The overlapped web 35 on member 77 increases the diameter of the windings of web 35 and the speed of the opening episode of bi-fold door 15. The opening speed of door 15 is a function of the diameter of the windings of web 35 around member 77 and the speed of motor 96. The guide plates 79 and 81 are aligned with slot 88 in shield 87 to track or maintain web 35 on member 77.

The door operator closes door 15 by actuating the down push button of switch 101. This reverses the drive of motor 96 whereby gear box 94 turns drive shaft 46 in a direction to unwind web 35 from member 77. This causes panels 18 and 19 to pivot relative to each other until they are aligned thereby closing door opening 17. The closing speed of door 15 decreases as the door moves down to the closed position due to the unwinding of web 35 from member 77.

A first modification of the bi-fold door 115 and door lift device for opening and closing the door is shown in FIGS. 12–16. The parts of bi-fold door 115 that correspond to the parts of bi-fold door 15 and door lift device 31 have the same reference number with the prefix 1.

Bi-fold door 115 is selectively moved to open and closed positions with door lift devices spaced along the length of the door. A door lift device 131, shown in FIG. 13, has an elongated, flexible and flat web 135 trained around a roller assembly 148 and attached to an anchor 139. Roller assembly 148 is secured to door frame 120. Anchor 139 is secured to a lower frame of door panel 118 to permit convenient adjustment of the tension and working length of web 135.

Figure 13:
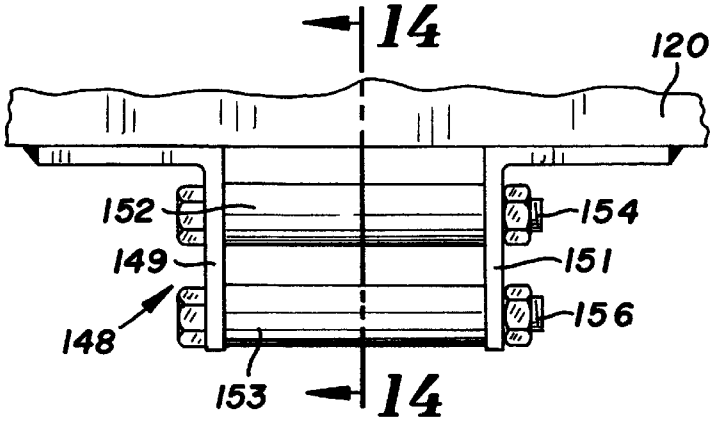
FIG. 13 is a front elevational view of the roller assembly shown in FIG. 12.
Figure 14:
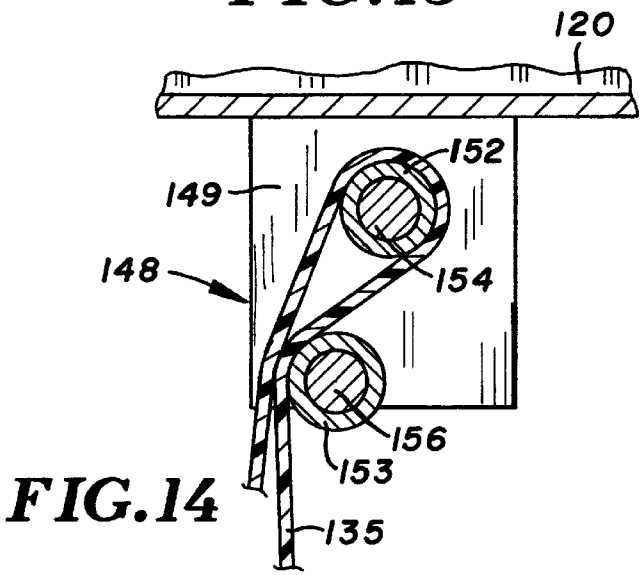
FIG. 14 is a sectional view taken along line 14—14 of FIG. 13 with the web located about the rollers of the roller assembly.

Roller assembly 148, shown in FIGS. 13 and 14, has a pair of angle brackets 149 and 151 secured with welds to frame 120. A pair of tubular members or cylindrical sleeves 152 and 153 extended between brackets 149 and 151 secured with welds to frame 120. A pair of tubular members of cylindrical sleeves 152 and 153 extended between brackets 149 and 151 are mounted on bolts 154 and 156.

Bolts 154 and 156 extend through aligned holes in brackets 149 and 151 to retain sleeves 152 and 153 on the brackets 149 and 151. Sleeves 152 and 153 are free to rotate on bolts 154 and 156. As shown in FIG. 14, sleeves 152 and 153 are laterally off-set from each other. Web 135 extends around sleeve 152 and bends about sleeve 153 toward anchor 139.

Figure 16:
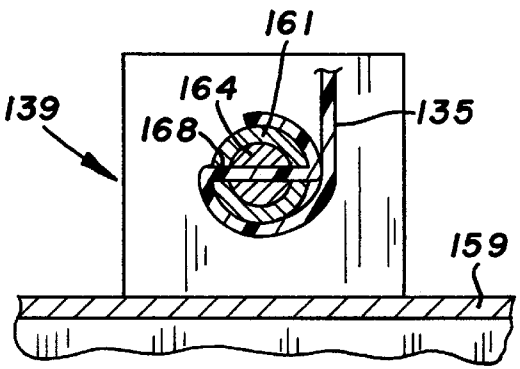
FIG. 16 is a sectional view taken along line 16—16 of FIG. 15 with the web attached to the anchor.

Anchor 139 has a pair of angle brackets 157 and 158 secured to door frame 159 with welds. A tubular sleeve 161 located between brackets 157 and 158 has one end 162 extended through a hold in bracket 158 and another end connected to a first nut 163. A threaded member 164 accommodating a second nut 166 and a washer 167 is threaded into first nut 163 to mount sleeve 161 on bracket 157. The middle of sleeve 161 has an elongated slot 168 having a length to accommodate web 135. As shown in FIG. 16, web 135 has an end extended through slot 168 and wrapped around sleeve 161 to secure the web to sleeve 161. Sleeve 161 is rotated to wrap several turns of the web around sleeve 161. The end 162 of sleeve 161 is turned to wind web 135. All of the anchors for the webs are adjustable to take up slack of the webs and equalize web tensions and working lengths of the webs.

Returning to FIG. 12, power unit 147 has a gear box 194 coupled to an electrical brake 197 which is operated with an electric motor 196. A pair of chain and sprocket drives 169 and 171 transmit power from gear box 194 to drive shaft 146.

Figure 12:
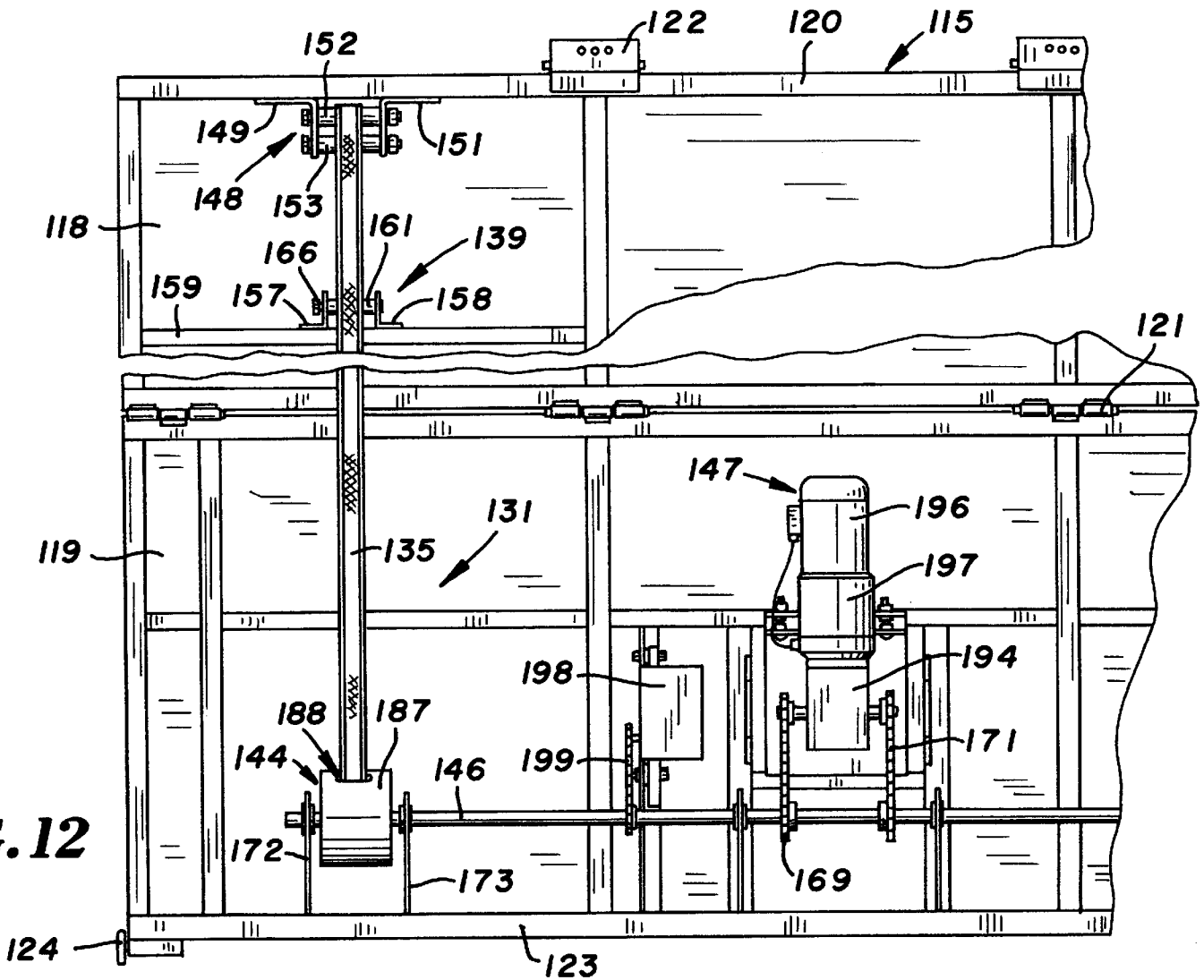
FIG. 12 is a foreshortened elevational view of the inside of a bi-fold door equipped with a first modification of the door opening and closing apparatus of the invention.
Figure 15:
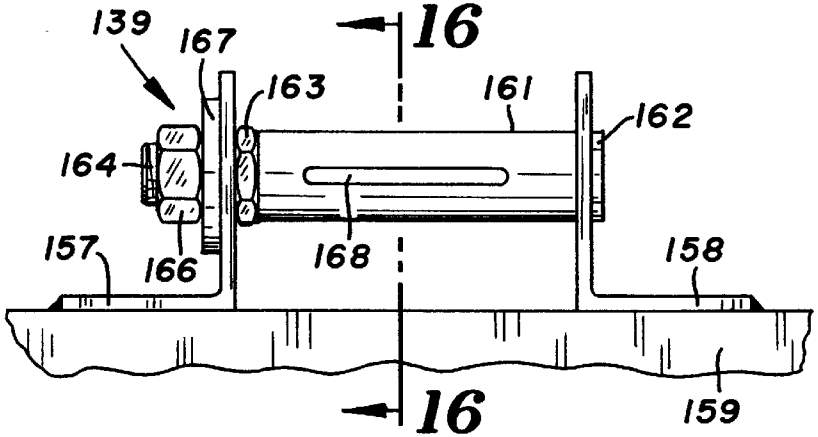
FIG. 15 is a front elevational view of the anchor for the web shown in FIG. 12.

In use when bi-fold door 115 is closed, as shown in FIG. 12, panels 118 and 119 are located in a common vertical plane closing a doorway in a structure. Electric motor 196 is operated and electric brake is released to deliver power to gear box 194. Chain and sprocket drives 169 and 171 transmit power to drive shaft 146. Shaft 146 operates all of the winches including winch 144 to wind up the webs. The windings of the webs on the winches overlap each other. This increases the working diameters of the webs on the winches and the speed of the opening episode of bi-fold door 115. When the operation of electric motor 196 is reversed, the webs unwind from the winches. This causes panels 118 and 119 to pivot relative to each other until they are vertically aligned thereby closing the doorway. The closing speed of door 115 decreases as the door 115 moves down to the closed position.

Figure 18:
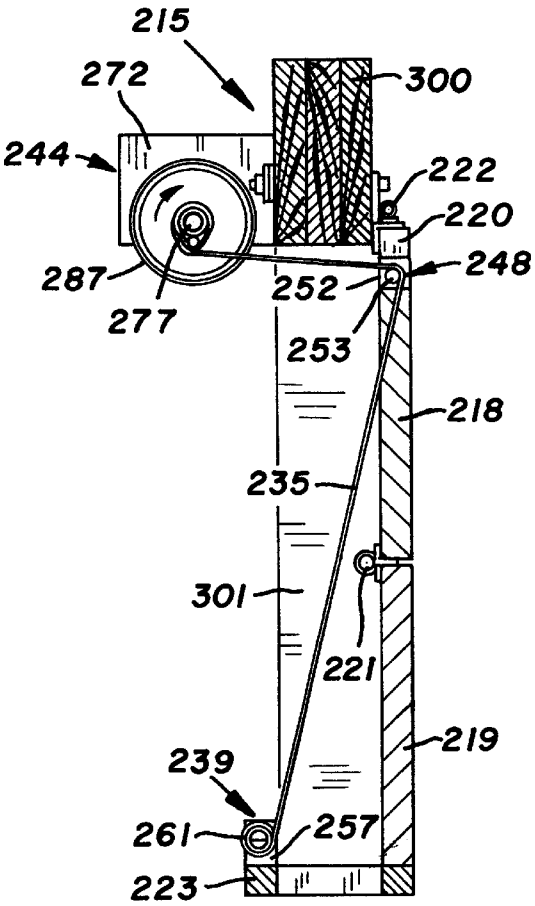
FIG. 18 is a sectional view taken along line 18—18 of FIG. 17.
Figure 17:
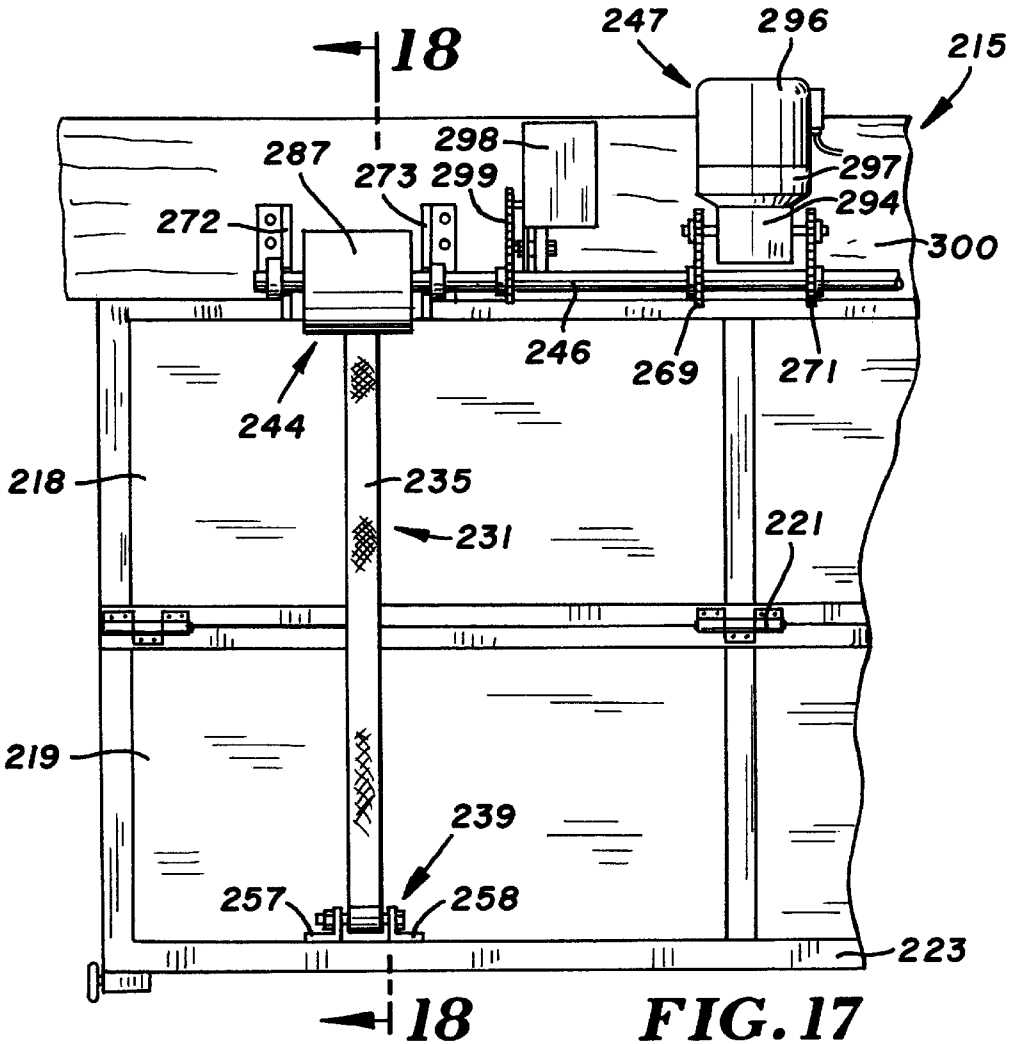
FIG. 17 is a foreshortened elevational view of the inside of a bi-fold door equipped with a second modification of the door opening and closing apparatus of the invention.

A second modification of the bi-fold door 215 and lift device for opening and closing the door is shown in FIGS. 17 and 18. The parts of bi-fold door 215 that correspond to the parts of bi-fold door 15 and door lift device 31 have the same reference numbers with the prefix 2.

Bi-fold door 215 is selectively moved to open and closed positions with door lift devices spaced along the length of the door. A door lift device 231, shown in FIG. 17, has an elongated, flexible and flat web 235 trained around a roller assembly 248 and attached to an anchor 239. Roller assembly 248 is secured to door frame 220. Anchor 239 is secured to a lower frame 223 of door panel 219 to permit convenient adjustment of the tension and working length of web 235.

Roller assembly 248, shown in FIG. 18, has a U-shaped bracket 252 secured with welds to frame 220. A roller 253 rotatably mounted on bracket 252 engages web 235 to direct web 235 from winch 244 down to anchor 239.

Anchor 239 has a pair of angle brackets 257 and 258 secured to door frame 223. A tubular sleeve 261 located between brackets 257 and 258 has one end attached to sleeve 261. The structure of anchor 239 is the same as anchor 139 shown in FIGS. 15 and 16. Sleeve 261 is rotated to adjust the working length and tension of web 235 the lock nut operatively connected to sleeve 261 retains the adjusted working length of web 235. All of the anchors for the webs are adjustable to take up slack of the webs and equalize web tensions and working lengths of the webs.

Returning to FIGS. 17, power unit 247 has a gear box 294 coupled to an electrical brake 297 which is operated with an electric motor 296. A pair of chain and sprocket drives 269 and 271 transmit power from gear box 294 to drive shaft 246. The power unit 247 is mounted on a header 300 or building structure located across the top of the doorway 301 in the side or end wall of the structure. The support plates 272 and 273 for winch 244 are mounted on header 300. Drive shaft 246 is located adjacent header 300 above doorway 301.

In use when bi-fold door 215 is closed, as shown in FIG. 17, panels 218 and 219 are located in a common vertical plane closing doorway 301 in a structure. Electric motor 296 is operated and electric brake 297 is released to deliver power to gear box 294. Chain and sprocket drives 269 and 271 transmit power to drive shaft 246. Shaft 246 operates all of the winches including winch 244 to wind up the webs. The windings of the webs on the winches overlap each other. This increases the working diameters of the webs on the winches and the speed of the opening episode of bi-fold door 215. When the operation of electric motor 296 is reversed, the webs unwind from the winches. This causes panels 218 and 219 to pivot relative to each other until they are vertically aligned thereby closing doorway 301. The closing speed of door 215 decreases as the door 215 moves down to the closed position.

While the invention has been described in connection with several embodiments thereof, it is understood by those skilled in the art that changes and arrangements of structures and materials may be made without departing from the scope of the invention.

What is claimed is:

1. An apparatus for opening and closing a door opening with a bi-fold door hinged to a structure having the door opening, said bi-fold door having an upper panel, a lower panel, and hinges connecting the upper and lower panels to allow the panels to move from a vertically aligned closed position to a folded side-by-side open position comprising:

door lift devices operable to selectively open and close the bi-fold door, reversible power means connected to the door lift devices for operating the door lift devices whereby the door lift devices are operable to open and close the bi-fold door, each of said door lift devices having a winch adapted to be mounted on the lower panel, said winch having a shaft, a cylindrical sleeve secured to the shaft, an elongated linear flexible web having a first end and a second end, and means connecting the first end of the web to the shaft, said shaft being connected to the reversible power means whereby the power means rotates the sleeve to wind the web in overlapping relation on the sleeve and unwind the web off the sleeve, and anchor means adapted to be mounted on the upper panel connected to the second end of the web whereby the power means rotates the sleeve to wind the web on the sleeve to open the bi-fold door and the power means rotates the sleeve to unwind the web off the sleeve to close the bi-fold door, said anchor means includes means to adjust the working length of the web to allow the door to move to the full open and closed positions, said means to adjust the working length of the web includes supports adapted to be secured to the upper panel, a member rotatably mounted on the supports, means connecting the second end of the web to the member whereby when the member is rotated the web is wound on the member to adjust the working length of the web, and means to hold the member in a fixed position relative to the supports to retain the web in its adjusted position.

2. The apparatus of claim 1 wherein: the web is an elongated generally flat member.

3. The apparatus of claim 1 wherein: the web is flexible and flat plastic and fiber member.

4. The apparatus of claim 3 wherein: the member is a Nylon web.

5. The apparatus of claim 3 wherein: the member is a polyester web.

6. The apparatus of claim 1 wherein: the means connecting the first end of the web to the shaft comprises plates secured to the shaft adjacent opposite ends of the sleeve, and a rigid member extended between and mounted on said plates, said first end of the web having a loop located between said plates accommodating the rigid member whereby when said shaft is rotated by the power means the web winds on itself around the sleeve to open the bi-fold door.

7. The apparatus of claim 6 wherein: the plates have axially aligned holes, and the rigid member is a bolt extended through the loop on the first end of the web and through the aligned holes in the plates, and a nut on the bolt to hold the bolt in assembled relation with the plates.

8. The apparatus of claim 1 including: a cylindrical shield surrounding the sleeve, first end of the web, and means connecting the first end of the web to the shaft, said shield having a slot, and said web extended through said slot.

9. The apparatus of claim 1 wherein: the member is a tubular member having an axial slot, said second end of the web having a loop extended through the slot, and a rod extended through the loop to hold the loop on the tubular member, said means to hold the member in a fixed position including a threaded member connected to the tubular member and a nut associated with the threaded member to clamp the tubular member to a support to hold the tubular member in a fixed position on the support.

10. The apparatus of claim 1 including roller means adapted to be mounted on the upper panel, said web extending from the winch to the roller means and around the roller means to the anchor means.

11. The apparatus of claim 1 wherein: the upper panel of the door has a top frame member and a bottom frame member, roller means adapted to be mounted on the top frame member, said anchor means adapted to be mounted on the bottom frame member, said web extending from the winch to the roller means and around the roller means to the anchor means.

12. An apparatus for opening and closing a door opening with a bi-fold door hinged to a structure having the door opening, said bi-fold door having an upper panel, a lower panel and means pivotally connecting the upper and lower panels to allow the panels to move from an aligned closed position to a folded side-by-side open position comprising: door lift devices operable to selectively open and close the bi-fold door, reversible power means adapted to be connected to the door lift devices for operating the door lift devices whereby the door lift devices open and close the bi-fold door, each of said door lift devices having an elongated flexible web having a first end and a second end, rotatable means attached to the first end of the web operably connected to the power means whereby on rotation of the rotatable means the web winds in overlapping relation around the rotatable means, means for mounting the rotatable means on one of the panels, and anchor means adapted to be mounted on the other panel connected to the second end of the web whereby the power means rotates the rotatable means to wind the web on the rotatable means to open the bi-fold door and the power means rotates the rotatable means to unwind the web off the rotatable means to close the bi-fold door, said anchor means includes means to adjust the working length of the web to allow the door to move to the open and closed positions, said means to adjust the working length of the web includes supports adapted to be secured to the upper panel, a member rotatably mounted on the supports, means connecting the second end of the web to the member whereby when the member is rotated the web is wound on the member to adjust the working length of the web, and means to hold the member in a fixed position relative to the supports to retain the web in its adjusted position.

13. The apparatus of claim 12 wherein: the web is an elongated generally flat member.

14. The apparatus of claim 12 wherein: the web is flexible and flat, plastic and fiber member.

15. The apparatus of claim 14 wherein: the member is a Nylon web.

16. The apparatus of claim 14 wherein: the member is a polyester web.

17. The apparatus of claim 12 wherein: the rotatable means includes a shaft connected to the power means, cylindrical means secured to the shaft, and means connecting the first end of the web to the shaft whereby upon rotation of the shaft in one direction the web winds in overlapping relation around the cylindrical means thereby moving the door from a closed position to an open position and upon rotation of the shaft in a direction opposite the one direction the web unwinds from the cylindrical means whereby the door moves from the open position to the closed position.

18. The apparatus of claim 17 wherein: the means connecting the first end of the web to the shaft comprises plates secured to the shaft adjacent opposite ends of the cylindrical means, and a rigid member extended between and mounted on said plates, said first end of the web having a loop located between said plates accommodating the rigid member whereby when said shaft is rotated in the one direction by the power means the web winds on itself around the cylindrical means to open the bi-fold door.

19. The apparatus of claim 18 wherein: the plates have axially aligned holes, and the rigid member is a bolt extended through the loop on the first end of the web and through the aligned holes in the plates, and a nut on the bolt to hold the bolt in assembled relation with the plates.

20. The apparatus of claim 16 including: a shield surrounding the cylindrical means, first end of the web, and means connecting the first end of the web to the shaft, said shield having a slot, and said web extended through said slot.

21. The apparatus of claim 14 roller means adapted to be mounted on the upper panel, said anchor means adapted to be mounted on the upper panel, said web extending from the rotatable means to the roller means and around the roller means to the anchor means.

22. A bi-fold door for an opening in a structure and apparatus for moving the bi-fold door between open and closed positions relative to the opening comprising: a first panel, means for movably mounting the first panel on the structure, a second panel, means pivotally connecting the first panel to the second panel to allow the first and second panels to be moved from aligned positions closing the opening to side-by-side folded positions opening the opening, door lift devices operable to selectively open and close the bi-fold door, reversible power means connected to the door lift devices for operating the door lift devices whereby the door lift devices open and close the bi-fold door, each of said door lift devices having an elongated flexible web having a first end and a second end, rotatable means attached to the first end of the web operably connected to the power means whereby on rotation of the rotatable means the web winds in overlapping rotation around the rotatable means, said rotatable means having a shaft connected to the power means, cylindrical mean mounted to the shaft, a pair of plates secured to the shaft located on opposite ends of the cylindrical means, and means connecting the first end of the web to the plates whereby upon rotation of the shaft in one direction the web winds in overlapping relation around the cylindrical means between the plates thereby moving the door at an increasing rate of speed from a closed position to an open position and upon rotation of the shaft in a direction opposite the one direction the web unwinds from the cylindrical means whereby the door moves at a decreasing rate of speed from the open position to web closed position, a cylindrical member surrounding the plates, the first end of the web, the means connecting the first end of the web to the plates and the portion of the web wound on the cylindrical means to shield the portions of the web wound on the cylindrical means, said cylindrical member having a closed end slot, said web extended through said slot, means mounting the rotatable means on one of the panels, and anchor means mounted on the other panel connected to the second end of the web extended from the cylindrical member whereby when the power means rotates the rotatable means to wind the web on the rotatable means the first and second panels pivot relative to each other to a side-by-side relationship to open the bi-fold door and when the power means rotates the rotatable means to unwind the web off the rotatable means whereby the upper and lower panels pivot relative to each other to aligned relationship to close the bi-fold door.

23. The door and apparatus of claim 22 wherein: the means connecting the first end of the web to the plates comprises a rigid member extended between and mounted on said plates, said first end of the web having a loop located between said plates accommodating the rigid member whereby when said shaft is rotated in the one direction by the power means the web winds on itself around the cylindrical means to open the bi-fold doors.

24. The door and apparatus of claim 23 wherein: said cylindrical member rides on said plates and surrounds the rigid member and loop of the first end of the web.

25. The door and apparatus of claim 22 wherein: the anchor means includes means to adjust the working length of the web to allow the door to move to the open and closed positions.

26. A bi-fold door for an opening in a structure and apparatus for moving the bi-fold door between open and closed positions relative to the opening comprising: a first panel having top and bottom horizontal frame members and sheathing secured to the frame members, means for movable mounting the first panel on the structure, a second panel having top and bottom horizontal frame members and sheathing secured to the frame members, means pivotally connecting the bottom frame member of the first panel to the top frame member of the second panel to allow the first and second panels to be moved from aligned positions closing the opening to side-by-side folded positions opening the opening, door lift devices operable to selectively open and close the bi-fold door, reversible power means connected to the door lift devices for operating the door lift devices whereby the door lift devices open and close the bi-fold door, each of said door lift devices having an elongated flexible web having a first end and a second end, rotatable means attached to the first end of the web operable connected to the power means, whereby on rotation of the rotatable means the web winds in overlapping rotation around the rotatable means, means mounting the rotatable means on one of the panels, and anchor means mounted on the other panel connected to the second end of the web whereby when the power means rotates the rotatable means to wind the web on the rotatable means, the first and second panels pivot relative to each other to a side-by-side relationship to open the bi-fold door and when the power means rotates the rotatable means to unwind the web off the rotatable means the upper and lower panels pivot relative to each other to aligned relationship to close the bi-fold door, said anchor means includes means to adjust the working length of the web to allow the door to move to the open and closed positions, said means to adjust the working length of the web includes supports secured to the first panel, a member rotatably mounted on the supports, means connecting the second end of the web to the member whereby when the member is rotated the web is wound on the member to adjust the working length of the web, and means to hold the member in a fixed position relative to the supports to retain the web in its adjusted position.

27. The door and apparatus of claim 26 including: roller means mounted on the top frame member of the first panel, said anchor means being mounted on the bottom frame member of the first panel, said web extending from the rotatable means to the roller means and around the roller means to the anchor means.

28. The door and apparatus of claim 27 wherein: the means mounting the rotatable means on one of the panels includes supports secured to the bottom frame member of the second panel.

29. An apparatus for opening and closing a door opening with a bi-fold door hinged to a structure having a header located over the door opening, said bi-fold door having an upper panel, a lower panel, and hinges connecting the upper and lower panels to allow the panels to move from a vertically aligned closed position to a folded side-by-side open position comprising:

door lift devices operable to selectively open and close the bi-fold door, reversible power means adapted to be connected to the door lift devices for operating the door lift devices whereby the door lift devices are operable to open and close the bi-fold door, each of said door lift devices having a winch adapted to be mounted on the header, said winch having a shaft, a cylindrical sleeve secured to the shaft, an elongated linear flexible web having a first end and a second end, and means connecting the first end of the web to the said shaft being connected to the reversible power means whereby the power means rotates the sleeve to wind the web in overlapping relation on the sleeve and unwind the web off the sleeve, and anchor means adapted to be mounted on the lower panel connected to the second end of the web whereby when the power means rotates the sleeve to wind the web on the sleeve the upper and lower panels pivot relative to each other to a side-by-side relationship to open the bi-fold door and when the power means rotates the sleeve to unwind the web off the sleeve the upper and lower panels pivot relative to each other to a generally vertical aligned relationship to close the bi-fold door, said anchor means includes means to adjust the working length of the web to allow the door to move to the full open and closed positions, said means to adjust the working length of the web includes supports adapted to be secured to the lower panel, a member rotatably mounted on the supports, means connecting the second end of the web to the member whereby when the member is rotated the web is wound on the member to adjust the working length of the web, and means to hold the member in a fixed position relative to the supports to retain the web in its adjusted position.

30. The apparatus of claim 29 wherein: the web is flexible and flat plastic and fiber member.

31. The apparatus of claim 29 wherein: the means connecting the first end of the web to the shaft comprises plates secured to the shaft adjacent opposite ends of the sleeve, and a rigid member extended between and mounted on said plates, said first end of the web having a loop located between said plates accommodating the rigid member whereby when said shaft is rotated by the power means the web winds on itself around the sleeve to open the bi-fold door.

32. The apparatus of claim 31 wherein: the plates have axially aligned holes, and the rigid member is a bolt extended through the loop on the first end of the web and through the aligned holes in the plates, and a nut on the bolt to hold the bolt in assembled relation with the plates.

33. The apparatus of claim 31 including: a shield surrounding the sleeve, first end of the web, and means connecting the first end of the web to the shaft, said shield having a slot, and said web extended through said slot.

34. The apparatus of claim 29 including roller means adapted to be mounted on the upper panel, said anchor means adapted to be mounted on the bottom panel, said web extending from the winch to the roller means and around the roller means to the anchor means.

35. A combination of a door and apparatus for opening and closing a door opening with said door comprising a bi-fold door hinged to a structure having a header located over the door opening, said bi-fold door hinged to a structure having a header located over the door opening, said bi-fold door having an upper panel, a lower panel and means pivotally connecting the upper and lower panels to allow the panels to move from an aligned closed position to a folded side-by-side open position, door lift devices operable to selectively open and close the bi-fold door, reversible power means connected to the door lift devices for operating the door lift devices whereby the door lift devices open and close the bi-fold door, each of said door lift devices having an elongated flexible web having a first end and a second end, rotatable means attached to the first end of the web operably connected to the power means attached to the first end of the web operably connected to the power means whereby on rotation of the rotatable means the web winds in overlapping relation around the rotatable means, means for mounting the rotatable means on the header, and anchor means mounted on a panel connected to the second end of the web on the rotatable means, the upper and lower panels pivot relative to each other to a side-by-side relationship to open the bi-fold door and when the power means rotates the rotatable means to unwind the web off the rotatable means the upper and lower panels pivot relative to each other to aligned relationship to close the bi-fold door, said anchor means includes means to adjust the working length of the web to allow the door to move to the open and closed positions, said means to adjust the working length of the web includes supports secured to the upper panel, a member rotatably mounted on the supports, means connecting the second end of the web to the member whereby when the member is rotated the web is wound on the member to adjust the working length of the web, and means to hold the member in a fixed position relative to the supports to retain the web in its adjusted position.

36. The combination of claim 35 wherein: the web is flexible and flat, plastic and fiber member.

37. The combination of claim 35 wherein: the rotatable means includes a shaft connected to the power means, cylindrical means secured to the shaft, and means connecting the first end of the web to the shaft whereby upon rotation of the shaft in one direction the web winds in overlapping relation around the cylindrical means thereby moving the door from a closed position to an open position and upon rotation of the shaft in a direction opposite the one direction the web unwinds from the cylindrical means whereby the door moves from the open position to the closed position.

38. The combination of claim 37 wherein: the means connecting the first end of the web to the shaft comprises plates secured to the shaft adjacent opposite ends of the cylindrical means, and a rigid member extended between and mounted on said plates, said first end of the web having a loop located between said plates accommodating the rigid member whereby when said shaft is rotated in the one direction by the power means the web winds on itself around the cylindrical means to open the bi-fold door.

39. The combination of claim 37 including: a shield surrounding the cylindrical means, first end of the web, and means connecting the first end of the web to the shaft, said shield having a slot, and said web extended through said slot.

40. The combination of claim 35 wherein: the upper panel has a top frame member, roller means mounted on the top frame member, said anchor means being mounted on the bottom panel, said web extending from the rotatable means to the roller means to the anchor means.

* * * * *